US011723452B2

(12) United States Patent
Alvarez

(10) Patent No.: US 11,723,452 B2
(45) Date of Patent: Aug. 15, 2023

(54) BRUSH WITH ROTATABLE ERGONOMIC ROUNDED HOOK

(71) Applicant: Rafael Alvarez, Aurora, IL (US)

(72) Inventor: Rafael Alvarez, Aurora, IL (US)

( * ) Notice: Subject to any disclaimer, the term of this patent is extended or adjusted under 35 U.S.C. 154(b) by 122 days.

(21) Appl. No.: 16/734,307

(22) Filed: Jan. 4, 2020

(65) Prior Publication Data

US 2020/0221858 A1 Jul. 16, 2020

Related U.S. Application Data

(60) Provisional application No. 62/790,538, filed on Jan. 10, 2019.

(51) Int. Cl.

| | |
|---|---|
| ***A46B 17/02*** | (2006.01) |
| ***A46B 5/02*** | (2006.01) |
| *A46B 17/04* | (2006.01) |

(52) U.S. Cl.

CPC ..... *A46B 17/02* (2013.01); *A46B 5/02* (2013.01); *A46B 17/04* (2013.01); *A46B 2200/202* (2013.01)

(58) Field of Classification Search

CPC ..... A46B 17/02; A46B 17/04; A46B 5/021; A46B 5/026; A46B 2200/202; A46B 2200/205; F61B 42/02

See application file for complete search history.

(56) References Cited

U.S. PATENT DOCUMENTS

| | | | | |
|---|---|---|---|---|
| 2,309,990 | A | 2/1943 | Savi | |
| 2,762,074 | A * | 9/1956 | Danchig | A46B 5/0095 15/167.1 |
| 2,905,419 | A | 9/1959 | Carson | |
| 2,988,768 | A | 6/1961 | Hill | |
| 3,612,464 | A | 10/1971 | Harrah | |
| 4,025,980 | A | 5/1977 | Neil | |
| 4,757,568 | A | 7/1988 | Jones | |
| 4,821,361 | A * | 4/1989 | Meimeteas | A46B 17/00 15/168 |
| 5,044,038 | A | 9/1991 | Matkovic | |
| 6,244,559 | B1 * | 6/2001 | Stanton | B44D 3/123 248/312.1 |
| 9,351,561 | B2 * | 5/2016 | McCarthy | A46B 3/12 |
| 10,051,952 | B2 * | 8/2018 | Aide | A46B 17/02 |
| 2003/0005533 | A1 * | 1/2003 | Woodnorth | B05C 17/0205 15/143.1 |

* cited by examiner

*Primary Examiner* — Laura C Guidotti
(74) *Attorney, Agent, or Firm* — The Law Offices of Konrad Sherinian, LLC

(57) ABSTRACT

An improved paint brush is disclosed. In particular, the improved paint brush includes a body portion and a handle extending therefrom. A plurality of bristles extends from the body portion, and can be held in place by a sleeve. A hook is disposed on and extends from the body portion. The underside of the hook is rounded so that a painter can place her thumb on the hook thereby obtaining a more stable grip allowing for more precise painting.

8 Claims, 7 Drawing Sheets

BRUSH WITH ROTATABLE ERGONOMIC ROUNDED HOOK

CROSS REFERENCE TO RELATED APPLICATIONS

This application claims priority to previously filed provisional application U.S. App. No. 62/790,538, titled "Brush with Rotatable Ergonomic Rounded Hook Allowing for a More Stable Grip," filed on Jan. 10, 2019 in the name of inventor Rafael Alvarez of Aurora, Ill.

FIELD OF THE DISCLOSURE

The present disclosure generally relates to an improved paint brush, and more particularly relates to a paint brush having a hook emerging from a body portion of the brush.

Background

Paint brushes of varying types are well-known in the art. The staple of painting professionals is a wooden brush incorporating a metal sleeve holding natural or synthetic bristles, depending on the particular application. A number of different attempts have been made in the prior art at integrating a hook into the handle or body portion of a paint brush. The attempts include U.S. Pat. No. 2,309,990 to Savi, which formed a hook out of a metal sleeve surrounding the paint brush; U.S. Pat. No. 2,905,419 to Carson, which utilized a wire hook construction; U.S. Pat. No. 2,988,768 to Hill, which includes a friction support mechanism; U.S. Pat. No. 3,612,464 to Harrah, which incorporates a wire hook; U.S. Pat. No. 4,025,980 to Neil, which incorporates a wire hook; U.S. Pat. No. 4,757,568 to Jones, which incorporates a specialized support and prying mechanism, and U.S. Pat. No. 5,044,038 to Matkovic, which includes a foldable hook. Painters have also used field modifications, such as inserting a screw into a brush handle to act as a makeshift hook so that it can be supported on a paint pail during normal use.

All of these solutions suffer from a variety of shortcomings. To start, the prior art hooks are generally sharp, and can injure a painter using them. In addition, as the prior art hooks are not comfortable to handle, they can interfere with the operation of the brush.

Objects of the Disclosed Systems, Methods, and Apparatus

Accordingly, it is an object of this disclosure to provide an improved paint brush.

Another object of this disclosure is to provide an improved paint brush incorporating a hook.

Another object of this disclosure is to provide an improved paint brush incorporating a hook with a rounded portion that is adapted to support a painter's digit.

Another object of this disclosure is to provide an improved paint brush allowing for a more stable grip.

Another object of this disclosure is to provide an improved paint brush allowing for easier painting of straight lines.

Another object of this disclosure is to provide an improved paint brush incorporating a thumb groove to support the user's thumb while painting.

Other advantages of this disclosure will be clear to a person of ordinary skill in the art. It should be understood, however, that a system, an apparatus or a method could practice the disclosure while not achieving all of the enumerated advantages, and that the protected disclosure is defined by the claims.

SUMMARY

An improved paint brush is disclosed and claimed herein. In particular, the improved paint brush includes a body portion as well as a handle extending from the body portion. A plurality of bristles extends from the body portion. A bored out aperture is disposed in the approximate center of the body portion, and a bored out area surrounds the bored out aperture. A hook is rotatably coupled to the body portion at the bored out aperture.

In one embodiment of the disclosed paint brush the hook is rotatably coupled to the body portion by a screw disposed through the bored out aperture.

In another embodiment of the disclosed paint brush a thumb groove is formed into the body of the paint brush to allow a user a place to rest her thumb. The thumb groove can comprise a substantially semi-circular shaped bored out area that is adjacent to the bored out area surrounding the aperture.

The hook can have a substantially flat exterior portion and an ergonomically rounded interior portion to allow the user to rest her thumb comfortably against the hook.

BRIEF DESCRIPTION OF THE DRAWINGS

Although the characteristic features of this disclosure will be particularly pointed out in the claims, the disclosure itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

This disclosure concerns an improved paint brush that incorporates a hook that allows a painter to hang the brush from the side of a paint pail during normal use. The hook is rounded on the lower portion so that it ergonomically couples with a painter's digit (such as her thumb), thereby allowing the painter to obtain a more stable and advantageous grip on the brush. The improved grip allows the painter to make more precise strokes while holding the hook. In addition, the rounded edge allows the user to maintain contact with the hook.

Figure 1:
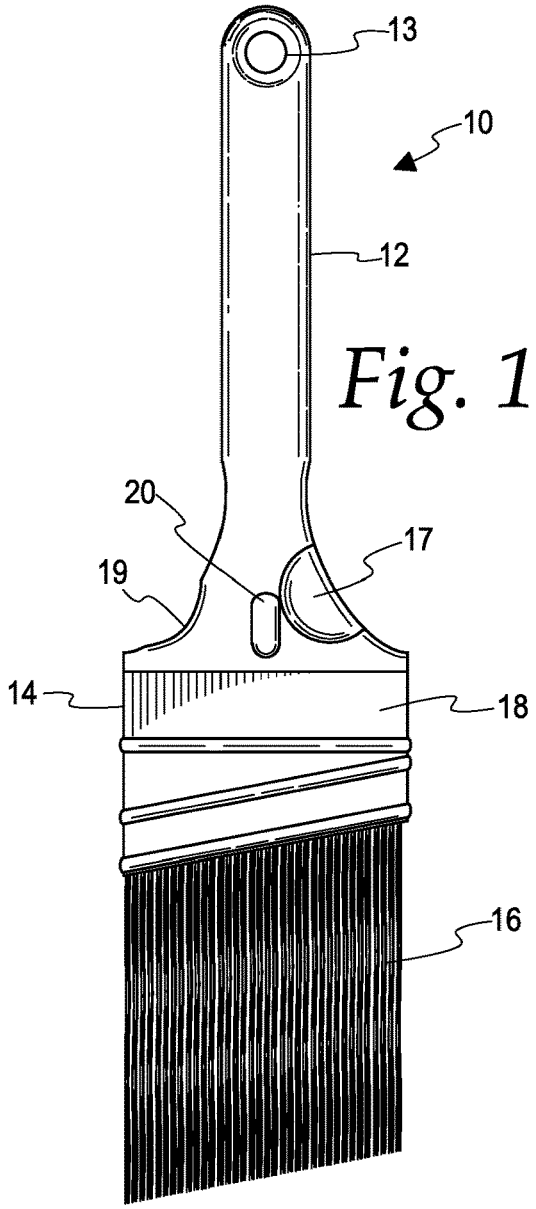
FIG. 1 is a front view of an improved paint brush constructed in accordance with this disclosure.
Figure 2:
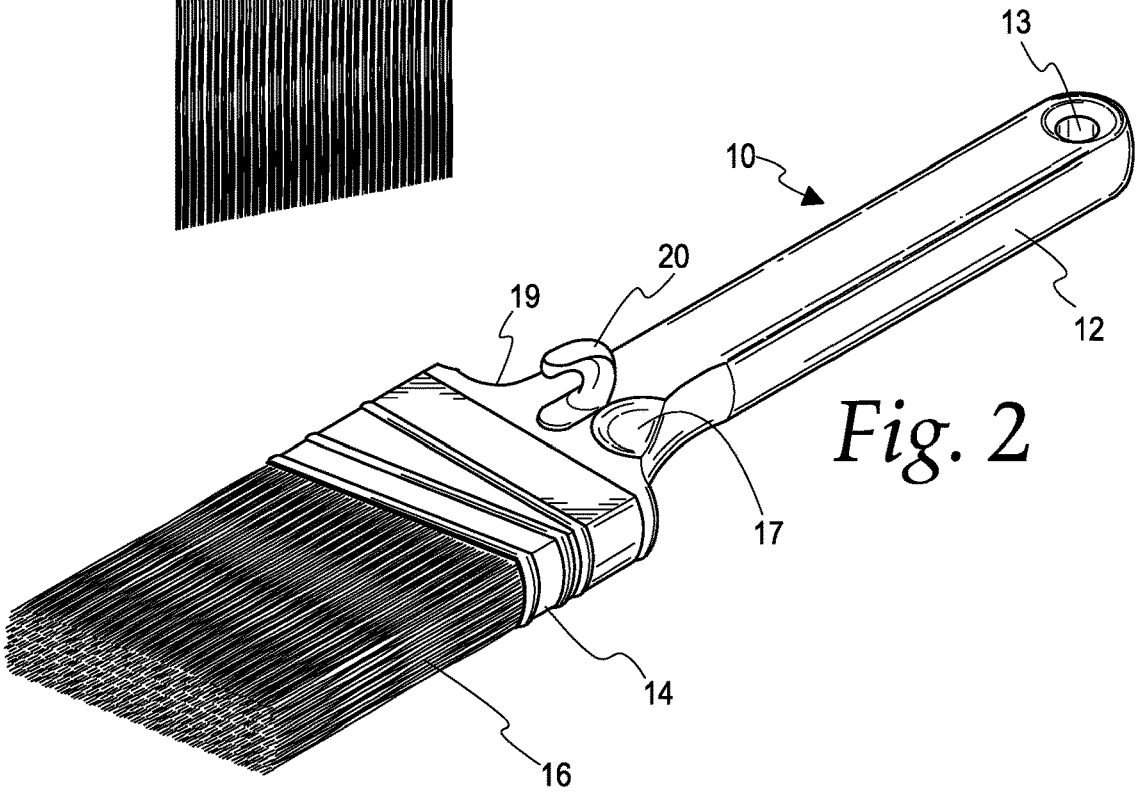
FIG. 2 is a front perspective view of an improved paint brush constructed in accordance with this disclosure.

Turning to the figures, and FIGS. 1 and 2 in particular, an improved brush 10 constructed in accordance with this disclosure is illustrated. The brush includes a handle 12 and a body portion 18 coupled to the handle 12. The handle 12 and body 18 can be constructed of a single piece or multiple pieces, and can be constructed of, for example, wood or plastic. Optionally, a hole 13 can be formed in the handle 12 to allow the handle to be hung when not in use. A bristle-holding sleeve 14 is disposed over the body 18. The sleeve 14 can be constructed of, for example, aluminum. A plurality of bristles 16 extends from, and are held in place, by the sleeve 14. A hook 20 extends from the body. The hook 20 can be constructed of, for example, metal, such as brass, bronze, or another suitable material. An ergonomic notch 17 is formed on the lower side of the body 18 so that the painter can comfortably rest her thumb there. Similarly, an additional ergonomic notch 19 is formed on the upper side of the body 18 so that the painter can rest his index finger. Ergonomic notches 17,19 allow the user to assume a very stable grip on the brush 10, thereby allowing the user to paint very precisely.

Figure 3A:
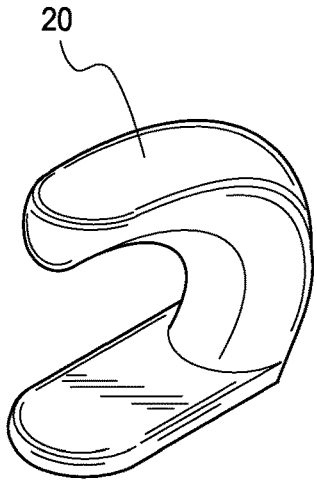
FIG. 3*a* is a perspective view of a rounded hook for use with the disclosed improved paint brush.
Figure 3:
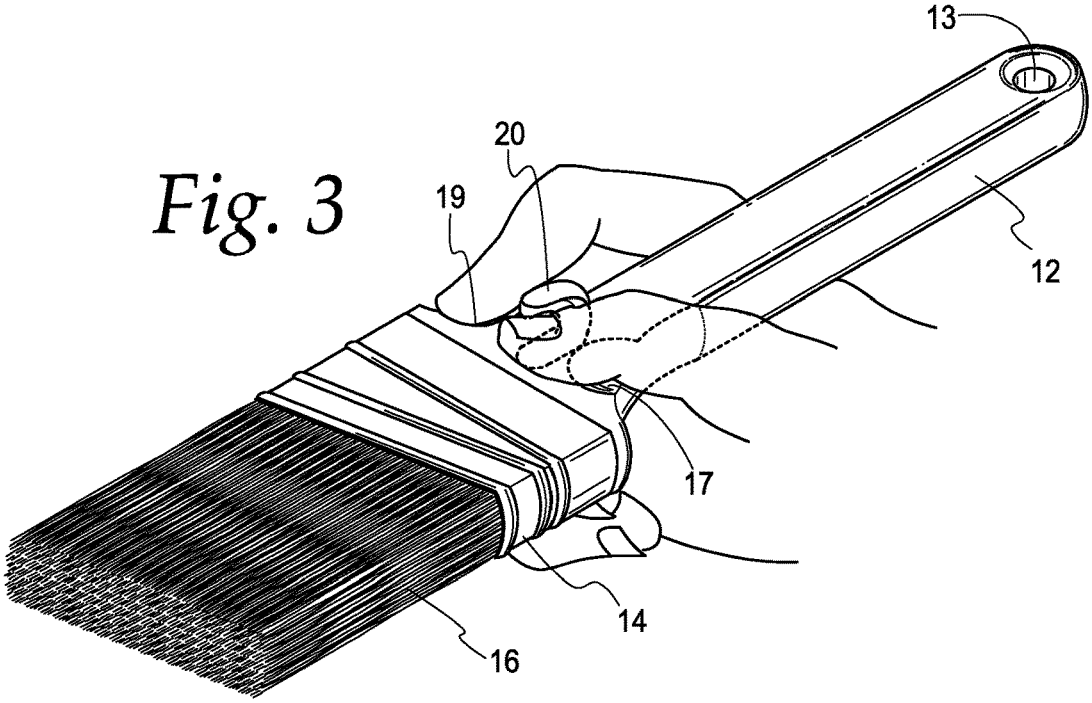
FIG. 3 is a front perspective view of an improved paint brush constructed in accordance with this disclosure as held by a painter.

Turning to FIG. 3, the improved brush 10 is shown as held by a user's hand. In particular, the user's thumb is used to hold and steady the brush while in use. In particular, as illustrated, the user's thumb supports the hook 20, which is rounded so that the user can comfortably hold the brush, while the user's index finger is disposed on top of the body 18 of the brush 10, and the user's remaining fingers are wrapped around the body 18 of the brush 10. While an exemplary grip is illustrated, other grips as known in the art could be used as well. FIG. 3*a* shows a closeup of the rounded hook 20. In particular, the notch can be of any dimensions; for example, the notch can be sufficiently deep to firmly couple to the side of a bucket so that it is not easily knocked off.

Figure 4:
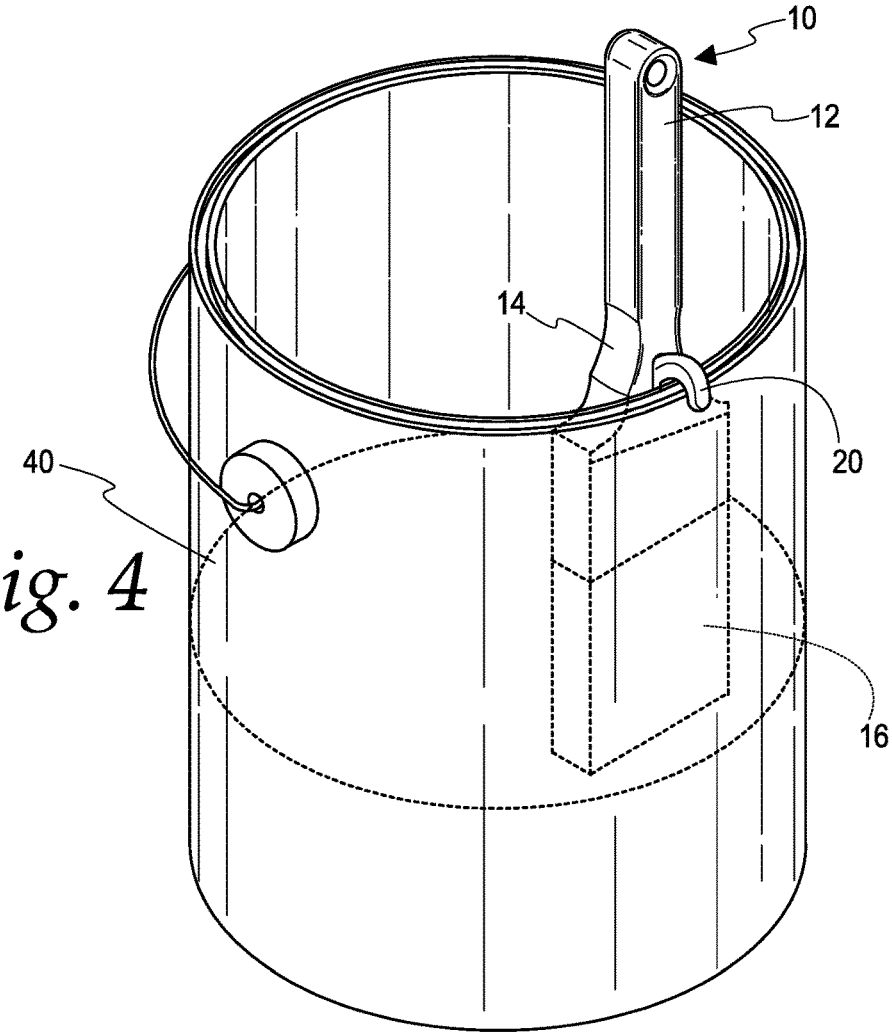
FIG. 4 is a perspective view of an improved paint brush as supported by a paint pail, as would be used by a painter in normal operation.

Turning to FIG. 4, the disclosed improved brush 10 is shown supported by the hook 20 on the lip of a paint pail 40. As illustrated, the bristles 16 of the brush 10 are entirely within the pail 40; accordingly, any paint within the bristles 16 will drip inside of the pail 40 rather than on a surface.

In addition to an improved paint brush, a case for the disclosed improved paint brush is also disclosed. The case is adapted to maintain the bristles of the brush in excellent condition by preventing common contaminants, such as dirt, from getting into them after the brush was recently used. The case is illustrated in FIGS. 5-8.

Figure 5:
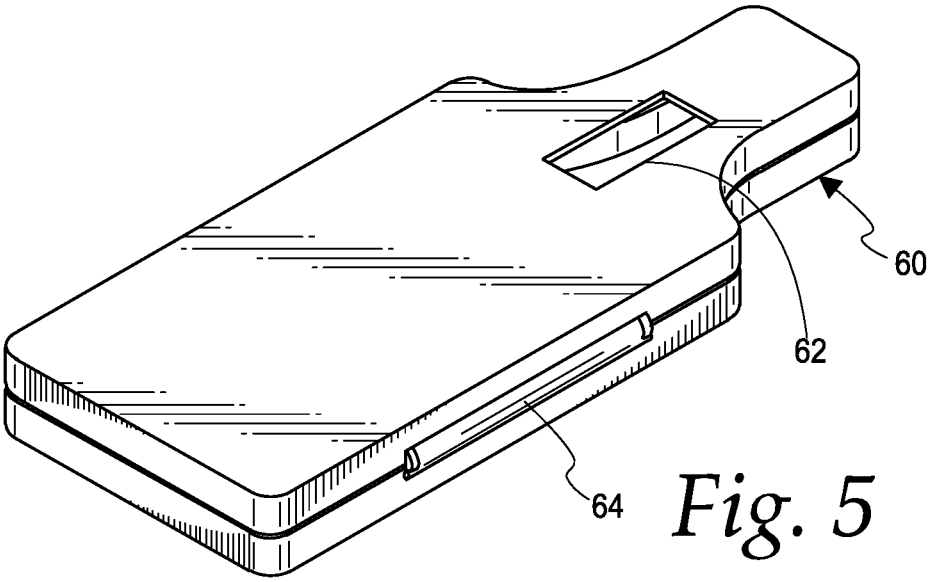
FIG. 5 is a top perspective view of a paint case for use with the disclosed improved paint brush.

Turning to FIG. 5, a case 60 for the improved brush 10 is illustrated. In particular, the case 60 is shown looking at its front in the closed position. The case includes an aperture 62, which, as discussed herein, is located to allow the hook 20 of the brush 10 to extend through the aperture 62 when a brush 10 is placed within the case 60. A clasp 64 can be seen on the right side of the case 60 as well. The case 60 can be constructed of, for example, a sturdy plastic.

Figure 6:
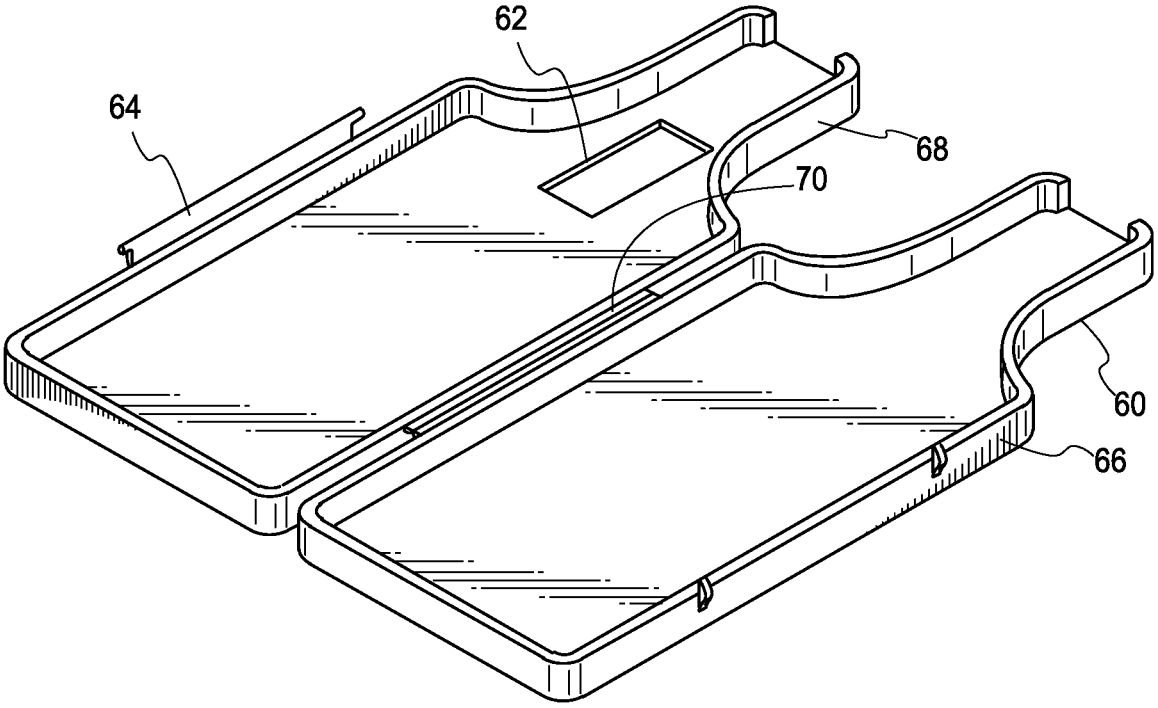
FIG. 6 is a top perspective view of an opened paint case for use with the disclosed improved paint brush.
Figure 7:
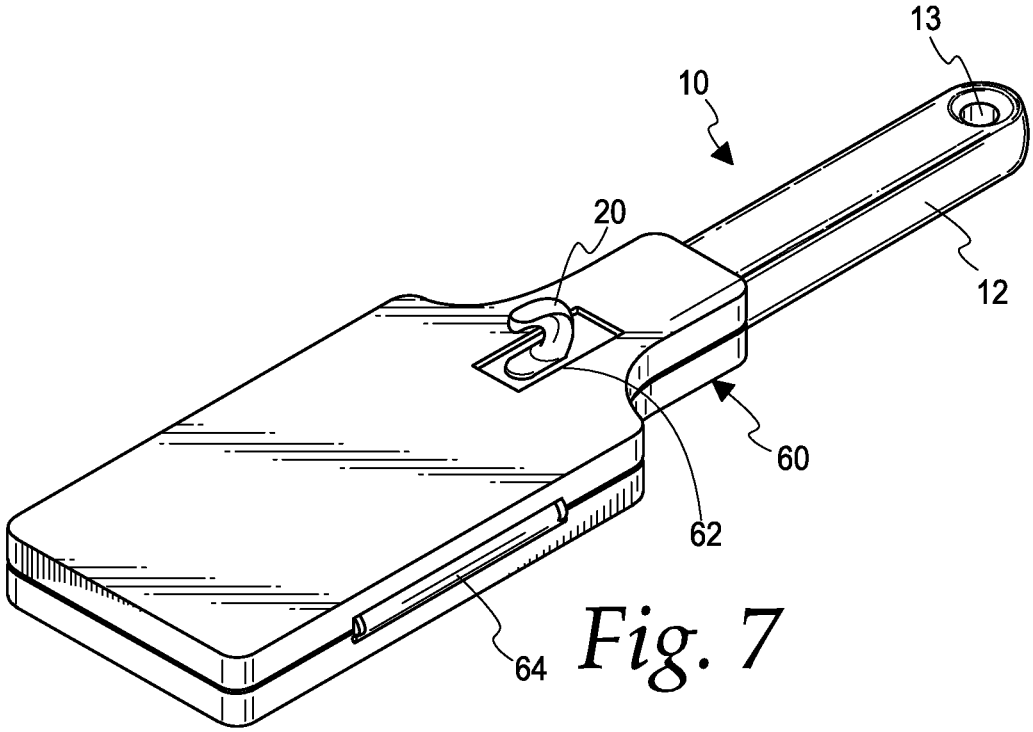
FIG. 7 is a top perspective view of a paint case holding the disclosed improved paint brush.
Figure 8:
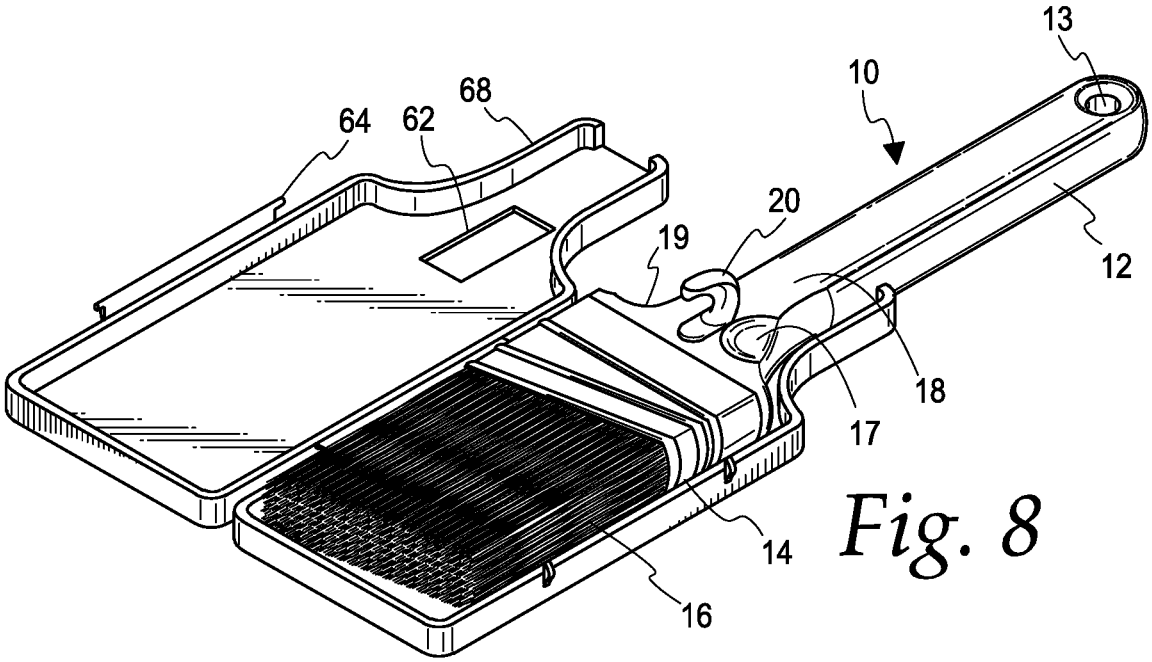
FIG. 8 is a top perspective view of an opened paint case holding the disclosed improved paint brush.

FIG. 6 depicts the case 60 in an open position. In the open position, the case 60 clearly comprises a lower casing 66 and an upper casing 68 joined by a hinge 70. The hinge 70 can, for example, be a formed plastic hinge, or another type of hinge. FIG. 7 depicts the case 60 holding the improved brush 10, and, in particular, the hook 20 is shown extending through the aperture 62, while the handle 12 and the aforementioned hole 13 extends through an opening towards the top of the case 60. Finally, FIG. 8 depicts the case 60 in an open position while holding the disclosed improved brush 10. As is visible, the aperture 62 is disposed so that when the case 60 is closed, the aperture 62 will be disposed directly over the hook 20 of the brush 10.

Figure 9:
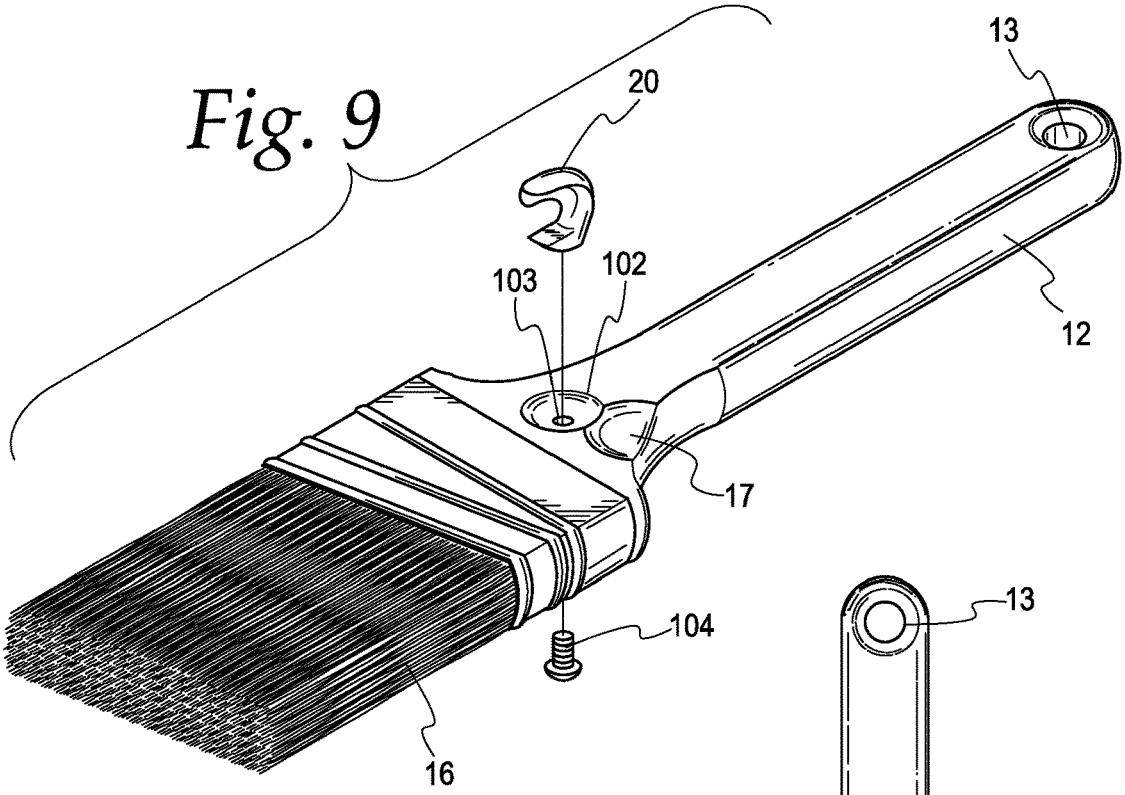
FIG. 9 is a front perspective view of an improved paint brush incorporating the disclosed rotatable ergonomic hook and constructed in accordance with this disclosure.
Figure 11:
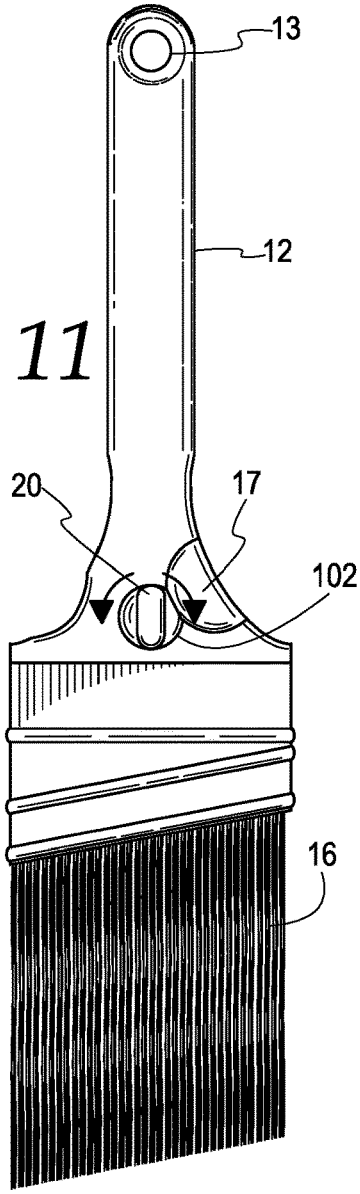
FIG. 11 is a top view of an improved paint brush incorporating the disclosed rotatable ergonomic hook of FIGS. 9 and 10.
Figure 10:
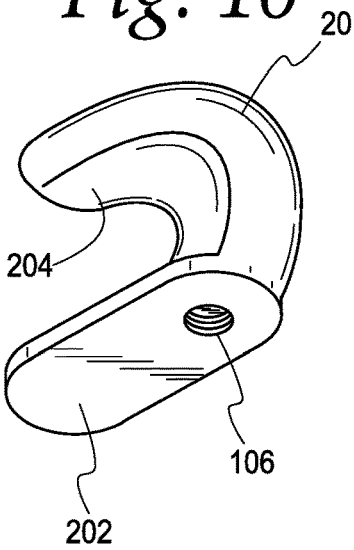
FIG. 10 is a rear perspective view of a hook for use with the improved paint brush of FIG. 9.

Turning to FIG. 9, an additional improvement is disclosed. In particular, the improved paint brush of FIG. 9 includes a bored aperture 103 that is surrounded by a bored out area 102. The hook 20 is coupled to the handle 12 by a screw 104. This allows the hook 20 to be rotated within the bored out area 102, and the screw 104 can then be tightened to hold the hook 20 in place. It should be noted that a variety of types of screw 104 can be used, and the screw 104 can be constructed of many types of materials, including metals, such as steel or aluminum, or plastic. Turning to FIG. 10, the back of the hook 20 is shown, along with the screw hole 106. The screw hole 106 is adapted to couple with the screw 104. Turning to FIG. 11, the rotatable nature of the hook 20 within the bored out area 102 is illustrated.

By allowing the hook 20 to rotate, an individual painter can adjust the hook for her or his comfort. In addition, this allows a painter to place the hook in one position for use, and another position for storage; i.e., to allow the brush to be stored with the bristles pointing up, if desired.

The paintbrush of FIGS. 9 through 11 also includes a thumb groove 17 formed in the handle 12 of the paintbrush. The thumb groove 17 provides a comfortable location for a painter to rest his thumb while applying pressure to the hook 20. This allows the painter to work for longer periods of time without fatigue.

Figure 12:
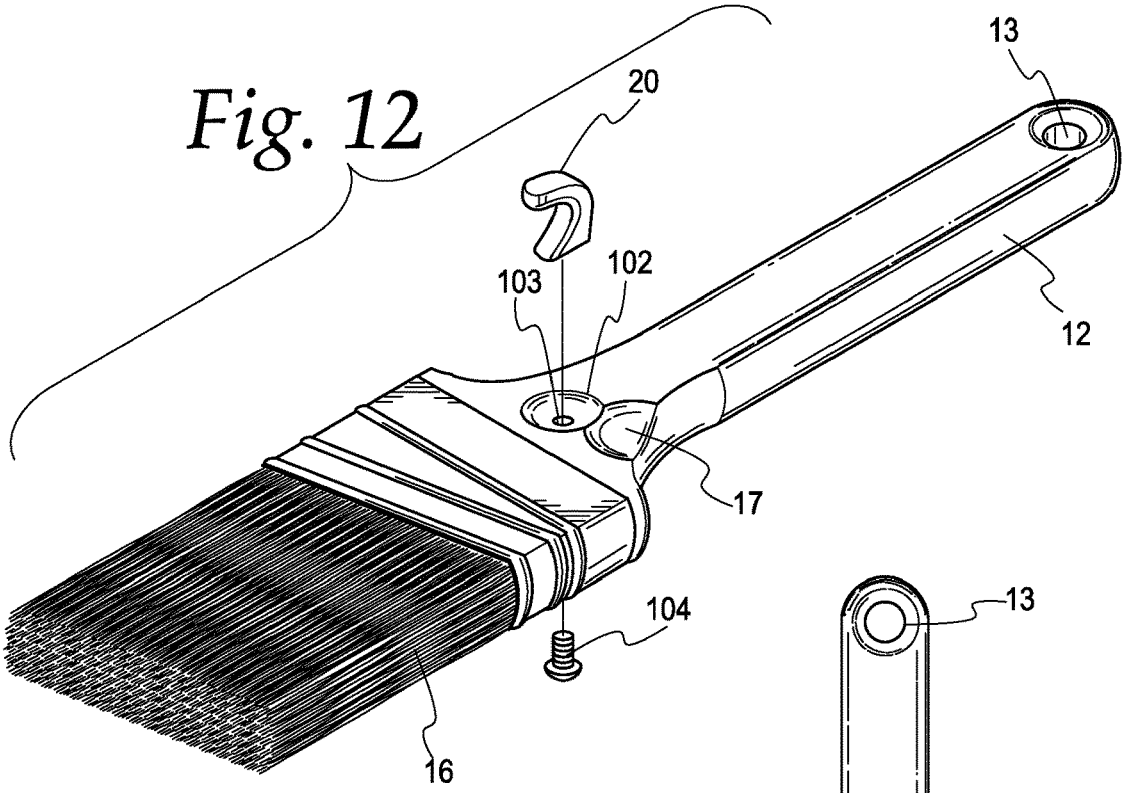
FIG. 12 is a front perspective view of an improved paint brush incorporating an alternative rotatable ergonomic hook constructed in accordance with this disclosure.
Figure 14:
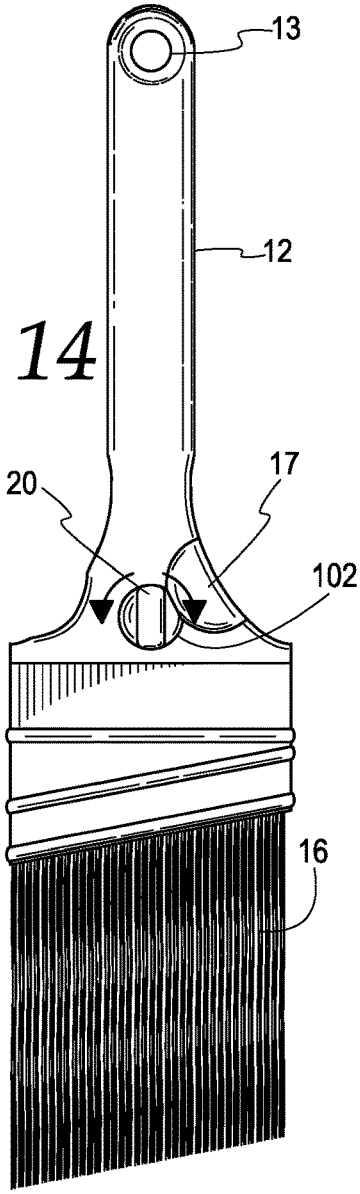
FIG. 14 is a top view of an improved paint brush incorporating the alternative rotatable ergonomic hook of FIGS. 12 and 13.
Figure 13:
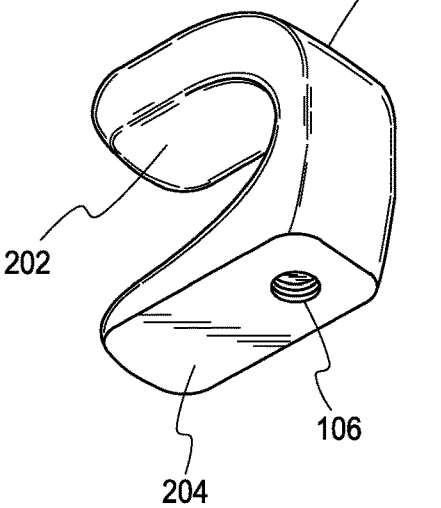
FIG. 13 is a rear perspective view of a hook for use with the improved paint brush of FIG. 12.

Turning to FIGS. 12, 13 and 14, an improved paintbrush with an alternative rotatable hook is disclosed. In particular, the brush of this embodiment is similar to the embodiment shown in FIG. 9. In particular, the paint brush of FIG. 12 includes a bored aperture 103 that is surrounded by a bored out area 102. The bored aperture 103 is disposed at approximately the center of the body portion of the paintbrush. The hook 20 is coupled to the handle 12 by a screw 104. By utilizing a screw 104, the hook 20 can be rotated within the bored out area 102, and the screw 20 can then be tightened to hold the hook 20 in place. As with the prior embodiment, various types of screw 104 can be used, and the screw 104 can be constructed of many types of materials, including metal, such as steel or aluminum, or plastic.

It should be noted that, while the screw 104 is the primary means disclosed for coupling the hook 20 to the body of the paintbrush, other means can work as well as long as a rotatable coupling is achieved. For example, the hook 20 could be coupled to the body of the paintbrush using a spring loaded pin, so that whenever the opposite end of the pin is pushed on, the hook 20 could rotate, and then lock in place when the pin was released.

Turning to FIG. 13, the back of the hook 20 is shown, along with the screw hole 106. The screw hole 106 is adapted to couple with the screw 104. Turning to FIG. 14, the rotation of the hook 20 within the bored out area 102 is illustrated.

By allowing the hook 20 to rotate, an individual painter can adjust the hook for her or his comfort. In addition, this allows a painter to place the hook in one position for use, and another position for storage; i.e., to allow the brush to be stored with the bristles pointing up, if desired.

The paintbrush of FIGS. 12 through 14 also includes a thumb groove 17 formed within the handle 12 of the paintbrush. The thumb groove 17 is adapted to provide a smooth and comfortable place for the painter to rest her thumb while applying pressure to the hook 20, so that the brush can be stabilized and a straighter stroke achieved. In particular, the thumb groove 17 can be substantially semi-circular in shape to allow the user the rest her thumb there. The ergonomic features of this paintbrush, such as the use of the thumb groove 17 and the ergomoic portion of the hook 20 can substantially reduce user fatigue, and allow painters to continue producing high quality strokes for significantly longer than paintbrushes without the ergonomic features of this paintbrush. In particular, in the embodiment of FIGS. 12-14, the side of the hook 20 that is closest to the user's thumb is ergonomically rounded so as to allow the user to comfortably rest her thumb there. In other embodiments, both sides of the hook can be rounded.

And, as with previous embodiments, a plurality of bristles 16 extends from the body portion of the paintbrush, and the bristles 16 can be held in place by a sleeve.

Figure 15:
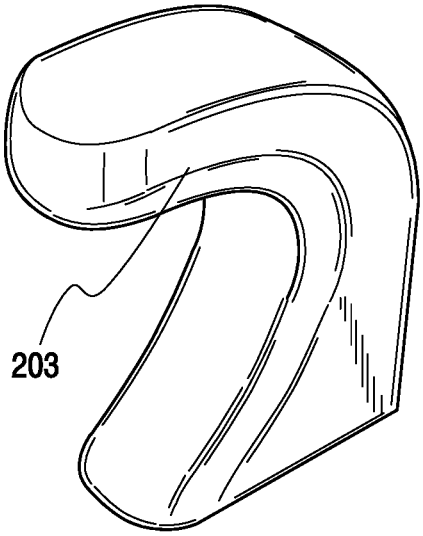
FIG. 15 is a top perspective view of an improved hook for use with a paint brush constructed in accordance with this disclosure.
Figure 16:
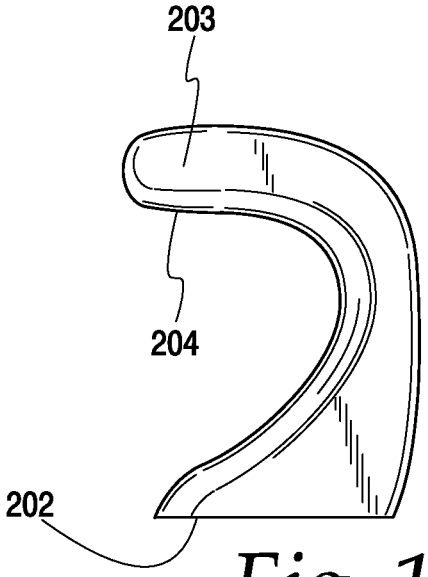
FIG. 16 is a side view of an improved hook for use with a paint brush constructed in accordance with this disclosure.
Figure 17:
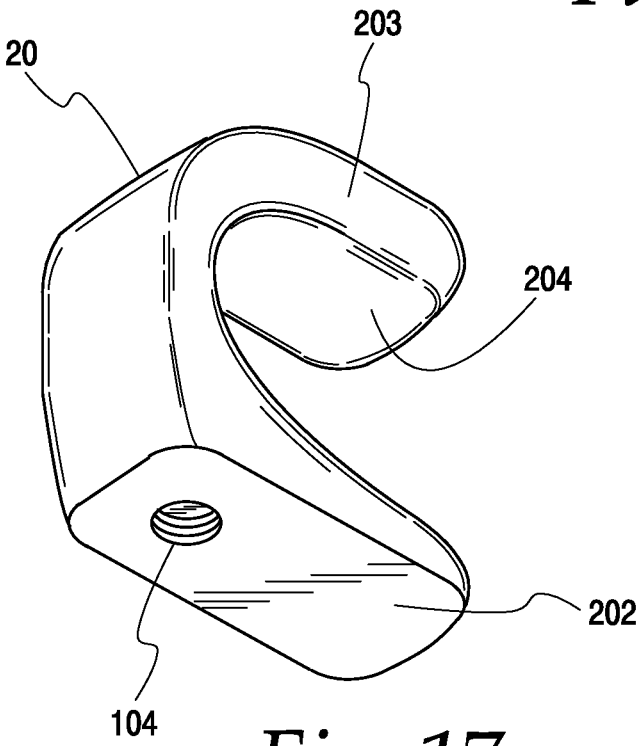
FIG. 17 is a bottom perspective view of an improved hook for use with a paint brush constructed in accordance with this disclosure.

Turning to FIGS. 15 through 17, an improved hook 20 is illustrated. In particular, the hook 20 includes a base 202. In this embodiment, the base 202 is substantially rectangular. In addition, the top 203 of the hook portion of the hook 20 is substantially flat; i.e., it is not rounded, and does not have an intentional texture. However, the underside 204 of the hook portion of the hook 20 is ergonomically rounded on one side (the side where the user would place his thumb) to provide a comfortable resting place for the painter's thumb.

The present disclosure should not be considered limited to the particular examples described above, but rather should be understood to cover all aspects of the disclosure as fairly set out in the attached claims. Various modifications, equivalent processes, as well as numerous structures to which the present disclosure can be applicable will be readily apparent to those of skill in the art to which the present disclosure is directed upon review of the instant specification.

It is intended that the scope of the disclosure not be limited by the specification, but be defined by the claims set forth below. In addition, although narrow claims may be presented below, it should be recognized that the scope of this disclosure is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, such additional subject matter is not dedicated to the public and the right to file one or more applications to claim such additional subject matter is reserved.

What is claimed is:

1. An improved paint brush comprising:
- a body portion;
- a handle extending from the body portion;
- a plurality of bristles extending from the body portion;
- a bored out aperture disposed near the center of the body portion;
- a bored out area surrounding the bored out aperture, the bored out area having a diameter; and
- a hook rotatably coupled to the body portion at the bored out area wherein a length of the hook does not extend beyond the bored out area, the hook having a substantially rectangular base coupled to the body portion and disposed within the bored out area so that the substantially rectangular base can rotate within the bored out area, a substantially flat top portion substantially parallel to the base, and an underside, whereby the underside extends from the top portion to the base in a substantially continuous curving trajectory, and wherein the underside is ergonomically rounded on one side.

2. The improved paint brush of claim 1 further comprising a screw disposed through the bored out aperture and rotatably coupled to the hook.

3. The improved paint brush of claim 1 further comprising a thumb groove formed into the body portion of the paint brush, the thumb groove being adapted to comfortably support a human thumb so that the human thumb rests on the ergonomically rounded side of the underside of the hook when supported in the thumb groove.

4. The improved paint brush of claim 3 wherein the thumb groove comprises a second bored out area disposed adjacent to the bored out area.

5. The improved paint brush of claim 4 wherein the thumb groove is substantially semi-circular in shape.

6. The improved paint brush of claim 3 wherein the thumb groove overlaps with the bored out area.

7. An improved paint brush comprising:
- a body portion;
- a handle extending from the body portion;
- a plurality of bristles extending from the body portion;
- a bored out aperture disposed near the center of the body portion;
- a bored out area surrounding the bored out aperture;
- a thumb groove formed into the body of the paint brush and overlapping with the bored out area; and
- a hook rotatably coupled to the body portion at the bored out area, the hook having a substantially rectangular base coupled to the body portion and disposed within the bored out area so that the substantially rectangular base can rotate within the bored out area, a substantially flat top portion substantially parallel to the base, and an underside, whereby the underside extends from the top portion to the base in a substantially continuous curving trajectory, and wherein the underside is ergonomically rounded on one side.

8. The improved paint brush of claim 7 wherein the hook has a length that does not extend beyond the bored out area.

* * * * *